US008011900B2

(12) United States Patent
Possamai et al.

(10) Patent No.: US 8,011,900 B2
(45) Date of Patent: Sep. 6, 2011

(54) HERMETIC COMPRESSOR WITH A HEAT DISSIPATION SYSTEM

(75) Inventors: Fabricio Caldeira Possamai, Costa e Silva-Joinville-SC (BR); Leonard L. Vasiliev, Minsk (BY)

(73) Assignee: Whirlpool S.A., Sao Paulo-SP (BR)

( * ) Notice: Subject to any disclaimer, the term of this patent is extended or adjusted under 35 U.S.C. 154(b) by 590 days.

(21) Appl. No.: 11/997,195

(22) PCT Filed: Jul. 31, 2006

(86) PCT No.: PCT/BR2006/000154

§ 371 (c)(1), (2), (4) Date: May 15, 2008

(87) PCT Pub. No.: WO2007/014443

PCT Pub. Date: Feb. 8, 2007

(65) Prior Publication Data

US 2008/0310974 A1 Dec. 18, 2008

(30) Foreign Application Priority Data

Aug. 1, 2005 (BR) ..... 0503282

(51) Int. Cl.
*F04B 39/06* (2006.01)
*F04B 17/03* (2006.01)
*F01B 31/08* (2006.01)

(52) U.S. Cl. ..... 417/372; 417/415; 417/902; 92/144

(58) Field of Classification Search ..... 417/312, 417/366, 372, 367, 423.8, 902, 313, 228, 417/415; 60/456; 92/144; 184/6.16, 6.21, 6.22

See application file for complete search history.

(56) References Cited

U.S. PATENT DOCUMENTS

| | | | | |
|---|---|---|---|---|
| 2,864,551 | A | 12/1958 | Heidorn et al. | |
| 4,718,829 | A * | 1/1988 | Ma | 417/372 |
| 5,651,258 | A | 7/1997 | Harris | |
| 5,695,004 | A | 12/1997 | Beckwith | |
| 5,762,478 | A * | 6/1998 | Lee | 417/312 |
| 6,347,523 | B1 | 2/2002 | Barrash et al. | |
| 6,412,479 | B1 | 7/2002 | Canfield et al. | |
| 6,499,977 | B2 | 12/2002 | Barito et al. | |

FOREIGN PATENT DOCUMENTS

| | | |
|---|---|---|
| EP | 0976993 | 2/2000 |
| JP | 56165781 | 12/1981 |
| JP | 59099080 | 6/1984 |

* cited by examiner

*Primary Examiner* — Devon C Kramer
*Assistant Examiner* — Bryan Lettman
(74) *Attorney, Agent, or Firm* — Gifford, Krass, Spinkle, Anderson & Citkowski, P.C.

(57) ABSTRACT

A heat dissipating system for a hermetic compressor includes a thermal energy transfer duct having a heat absorbing end mounted to the cylinder block of the compressor to absorb the heat generated by the compression of the refrigerant fluid in the cylinder block and a heat releasing end positioned away from the heat absorbing end and away from the cylinder block in order to release the heat conducted from the cylinder block by the transfer duct.

14 Claims, 9 Drawing Sheets

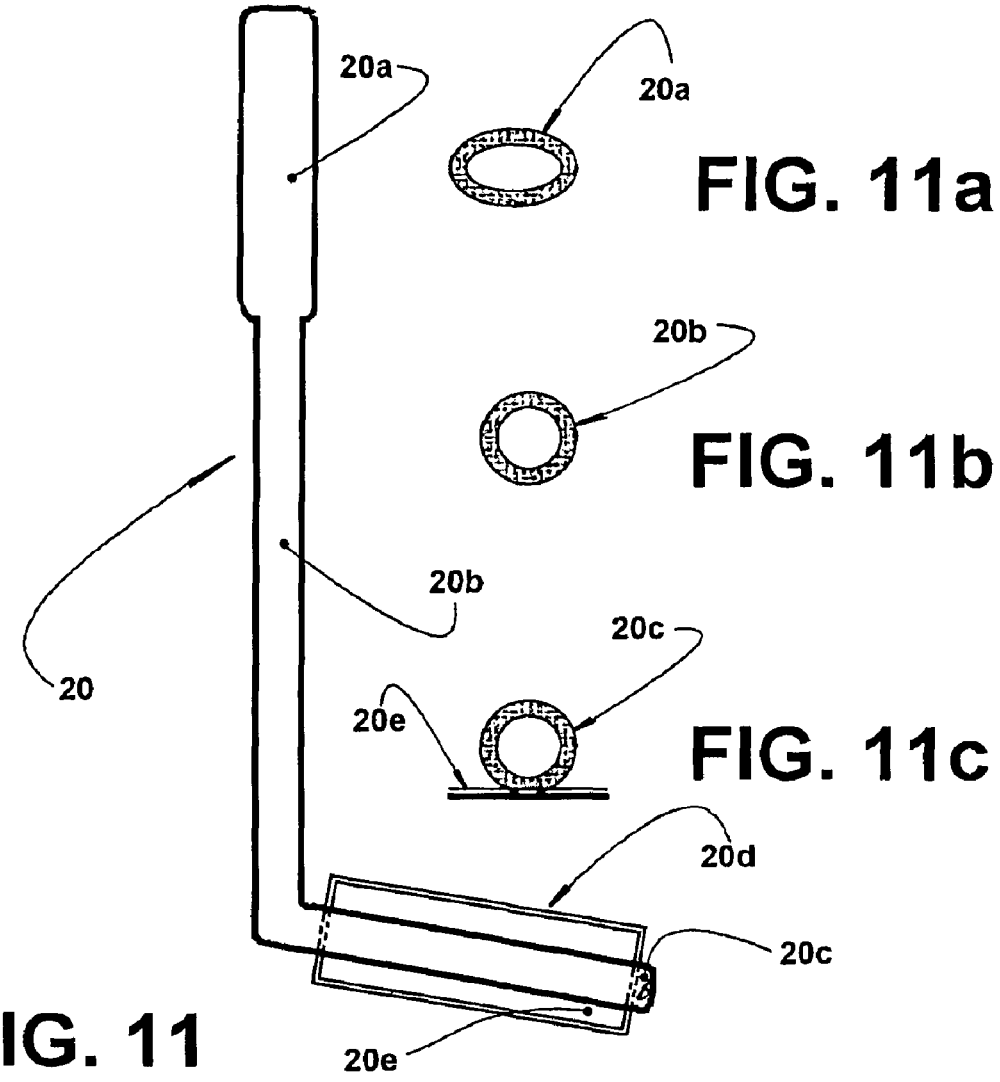
FIG. 11a
FIG. 11b
FIG. 11c
FIG. 11
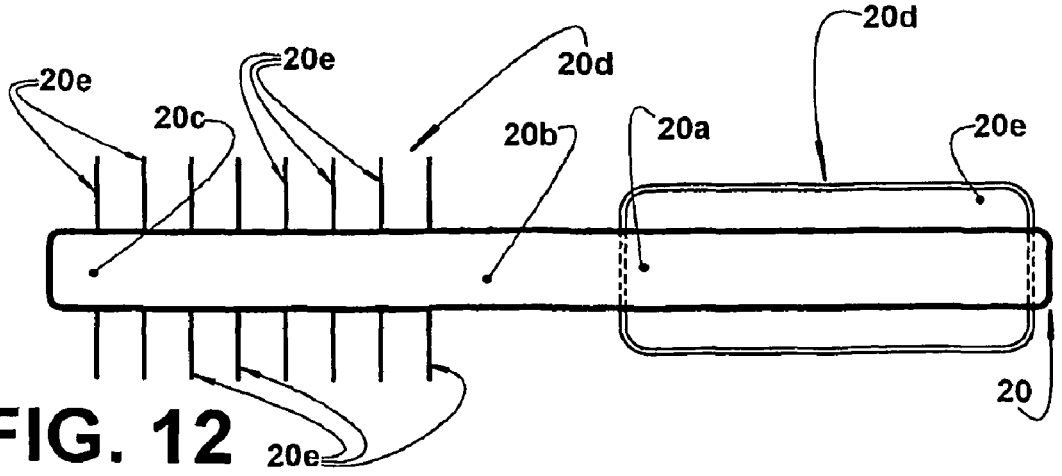
FIG. 12

HERMETIC COMPRESSOR WITH A HEAT DISSIPATION SYSTEM

CROSS REFERENCE TO PRIOR APPLICATION

This application is the U.S. national phase of International Application No. PCT/BR2006/000154, filed Jul. 31, 2006, which claims priority from Brazilian Patent Application No. PI0503282-2, filed Aug. 1, 2005. The disclosures of both applications are incorporated herein by reference in their entirety. The International Application published in English on Feb. 8, 2007 as WO 2007/014443 A1 under PCT Article 21(2).

FIELD OF THE INVENTION

The present invention refers to a hermetic compressor of the type used in refrigeration appliances, such as refrigerators and freezers, and which is provided with a heat dissipation system in the interior of the compressor, said system being particularly used to transfer thermal energy from the hot parts of the interior of the compressor to ambients located external and distant from the cylinder block thereof.

BACKGROUND OF THE INVENTION

Hermetic compressors of the type used in refrigeration systems usually comprise, in the interior of a casing, a motor-compressor assembly having a cylinder block within which is defined a cylinder having an end closed by a cylinder head defining, therewithin, a discharge chamber in selective fluid communication with a compression chamber defined inside the cylinder and which is closed by a valve plate provided between the closed end of the cylinder and the cylinder head, said fluid communication being defined through suction and discharge orifices provided in said valve plate and which are selectively and respectively closed by suction and discharge valves generally carried by the valve plate.

During the compression of gas, heat is generated as a result of different processes, such as: the heating of the gas during compression; the losses due to attrition on the bearings, where the power by viscous attrition is transformed into thermal energy and heat; and the losses in the electric motor, which are also transformed in heat.

In its constructive form, the compressor is mounted in a casing connected to the refrigeration system which includes, besides the compressor, a condenser, an evaporator and an expanding device. This circuit is hermetically sealed, not transferring mass to the external ambient.

One part of the thermal power generated by the compressor is sent with the refrigerant fluid to the discharge line and dissipated in the condenser of the refrigeration system. The other part is transferred to the refrigerant fluid and to the lubricant oil contained in the interior of the casing. On their turn, the refrigerant fluid and the lubricant oil transfer the other part of the heat to the casing, which dissipates said other part of the generated heat to the external ambient.

This system achieves a thermal balance when certain conditions are maintained constant, such as for example the temperature of the external ambient and the operating condition of the compressor, considering as constant the evaporation and condensation pressures and the ventilation characteristics.

In this situation of thermal balance, a temperature profile can be established, which is directly related to the energetic efficiency of the compressor, since, on one hand, the heating of the ambient of the casing causes heating of the lubricant oil, reducing its viscosity and the power that is lost by viscous attrition. The load capacity of the hydrodynamic bearing is dimensioned taking into account this viscosity reduction. On the other hand, there are many negative aspects resulting from the heating within the casing, such as: temperature increase of the refrigerant fluid being drawn; compression power increase resulting from the high temperature of the cylinder; and the need to use special materials in the construction of the compressor to resist the high temperatures.

The usual process of heat transfer from the inside to the outside of the compressor presently occurs as follows: the heat generated in the compression of the refrigerant fluid is transmitted to the cylinder block and to the discharge muffler and then it is transferred, by convection, to the gas in the internal ambient of the compressor and also to the oil falling on said heated surfaces. The gas and the oil will change heat with the internal walls of the casing and the heat will have to trespass the wall of the casing by conduction, to be finally dissipated, by natural or forced convection, from the compressor body to the external ambient. In this process, there is a series of thermal resistances that impair heat exchange and heat dissipation.

There are also known from the art the following heat transfer processes: by forced ventilation occurring between the internal components and the lubricant oil and between the compressor body and the ambient outside its casing; and by cooling the lubricant oil through a cooling pipe, through which the refrigerant fluid of the condenser of a refrigeration system to which the compressor belongs is deviated to a heat exchanger immersed in the oil inside the compressor, removing heat therefrom.

The known prior art presents different alternatives to promote heat transfer, such as: using heat exchangers with Stirling machines, as taught in patent U.S. Pat. No. 6,347,523; providing fins in the cylinder heads and an auxiliary air circulation system; using heat pipes; using a fluid pumping system by means of pumps driven by oscillatory, mechanical and electrical movements, etc.

However, such known solutions present some disadvantages. In the case of the known solutions which use finned cylinder heads and heat exchange with air, the disadvantage resides in the fact that it is not possible to achieve high heat transfer capacity. In said systems, a saturation limit in relation to the heat transfer capacity is easily achieved. This occurs as a function of the saturation of the efficiency of the fins by increasing the length of and/or decreasing the distance between the fins, or by the impossibility of finding air moving equipments with sufficient capacity to allow reaching the pressure and flowrate levels which are required in determined heat transfer capacities. Moreover, such solutions lead to an increase of vibrations and noise in the refrigeration system and to less reliability due to the large amount of movable parts they have.

In a known solution disclosed in patent U.S. Pat. No. 6,499,977 a scroll compressor carries, in its exterior, a refrigeration system using a heat pipe. In this solution, the heat in the compressor casing is removed by means of a heat pipe system. Heat transfer is improved only from the external surface of the casing to the external ambient, maintaining constant the other thermal resistances. Such compressor has a constructive characteristic in which the cylinder is directly exposed to the external ambient and therefore the high thermal resistance of the gas of the internal ambient does not cause any damages to said compressor. However, for the reciprocating hermetic compressor it is highly desirable to minimize or eliminate such internal thermal resistance of the gas.

Another solution of heat transfer by using heat pipes is disclosed in patent U.S. Pat. No. 6,412,479, in which the heat pipes are provided in the interior of an internal combustion engine to remove heat from the cylinder head. Nevertheless, said solution refers to an internal combustion engine (and not to a hermetic compressor) in which the objective is to re-use the unburnt gases of the discharge in the supply system.

Other known solutions described in patents U.S. Pat. No. 5,651,258 and U.S. Pat. No. 5,695,004 also present a heat pipe system for removing heat from the interior of the compressor, re-using or not said heat in a refrigeration system to which the compressor is associated. Such solutions however are not directed to the issue of energetic efficiency of a hermetic compressor, since the heat pipes are applied to the system to use said heat and not to remove it from the hot parts of a hermetic compressor.

OBJECTS OF THE INVENTION

Thus, it is an object of the present invention to provide a hermetic compressor with a heat dissipating system in the interior of the compressor casing, particularly to remove heat from its cylinder block, reducing the whole thermal resistance therewithin and making its inner temperature more homogeneous, without the problems found in the known solutions, such as higher energy consumption and need of using special material to resist high temperatures.

It is a further object of the present invention to provide a compressor such as cited above, which allows the heat dissipated from the parts thereof to be transferred to the exterior of the compressor casing.

SUMMARY OF THE INVENTION

These and other objects are attained by a hermetic compressor with a heat dissipating system, said compressor comprising: a casing within which is defined an oil sump; a cylinder block mounted inside the casing and defining a cylinder, for compression of a refrigerant fluid, having an end closed by a cylinder head in which is defined a discharge chamber, said heat dissipation system comprising a thermal energy transfer duct having a heat absorbing end mounted to the cylinder block in order to absorb the heat generated by compression of the refrigerant fluid inside the cylinder, and a heat releasing end provided away from the cylinder block in order to conduct and liberate the heat absorbed therefrom to another means at a temperature which is lower than the temperature of the means in which the absorption occurs.

The present solution considers the application of heat exchangers such as heat pipes, which effect heat exchange very efficiently and allow a high amount of heat to be removed from specific regions of the compressor, more particularly from the hot parts associated with the cylinder block, conducting said heat to another means located inside or outside the casing.

BRIEF DESCRIPTION OF THE DRAWINGS

The invention will be described with reference to the enclosed drawings given by way of example of a preferred embodiment and in which:

FIG. 11 illustrates, schematically, a lateral view of a construction of the thermal energy transfer duct of the present invention;

FIGS. 11*a*, 11*b* and 11*c* illustrate, schematically, cross-sectional views of each portion of the thermal energy transfer duct shown in FIG. 11;

FIG. 12 illustrates, schematically, a lateral view of another construction of the thermal energy transfer duct of the present invention;

DETAILED DESCRIPTION OF THE ILLUSTRATED EMBODIMENT

Figure 1:
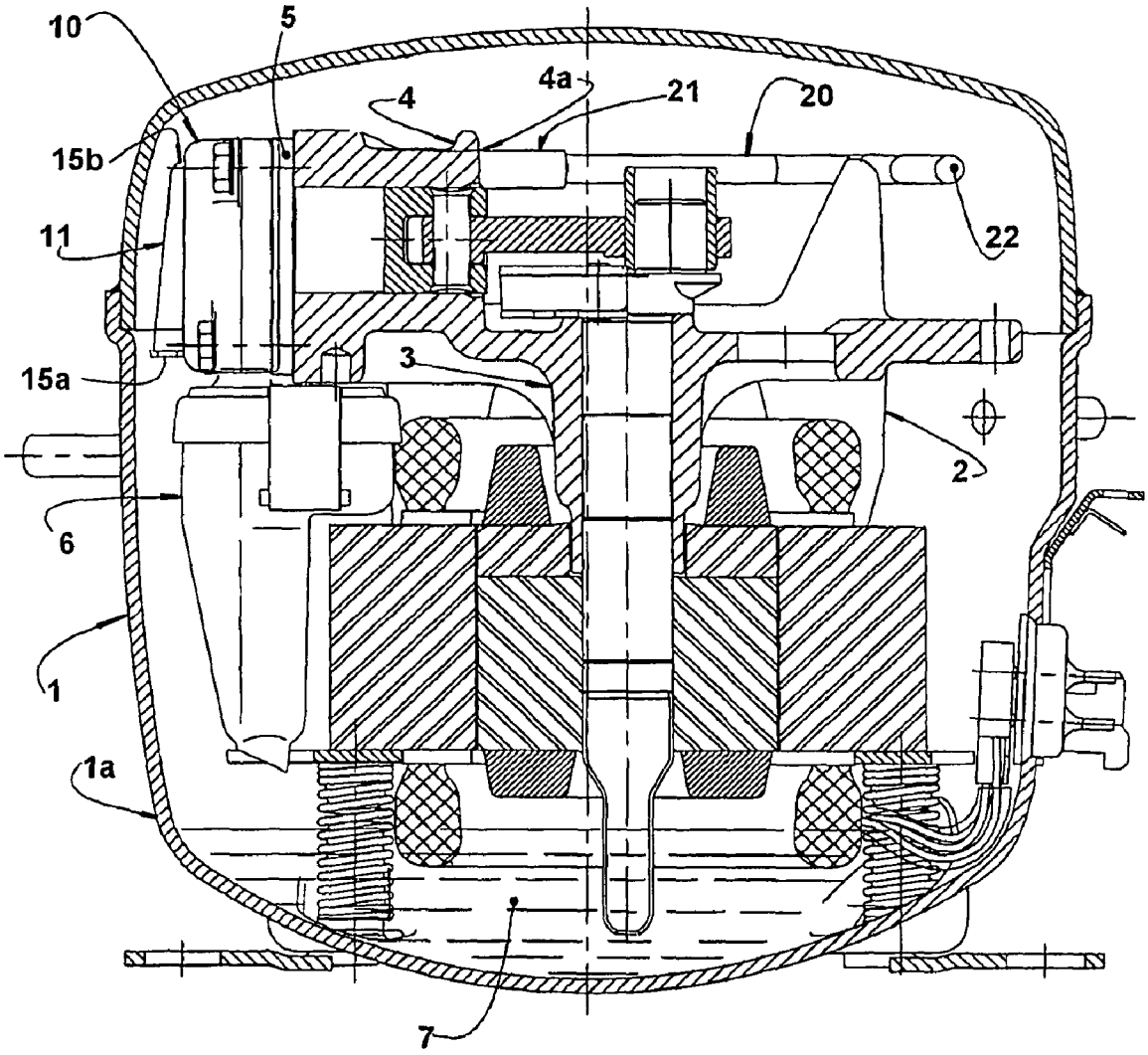
FIG. 1 illustrates, schematically and in a cross-sectional view, a refrigeration compressor illustrating a first embodiment of the refrigeration system of the present invention.

The heat dissipation system of the present invention is designed to be applied in a compressor of the type used in refrigeration systems of refrigeration appliances, said compressor comprising, within a hermetic casing 1, a motor-compressor assembly having a cylinder block 2 in which is defined a cylinder 3 housing, at one end, a piston (not illustrated) which compresses a refrigerant fluid and having an opposite end 4 closed by a cylinder cover or cylinder head 10 within which is defined a suction chamber and a discharge chamber (not illustrated), which maintain a selective fluid communication with a compression chamber (not illustrated) defined inside the cylinder 3 between a piston top portion and a valve plate 5 provided between the opposite end of the cylinder 3 and the cylinder head 10 through suction and discharge orifices (not illustrated) provided in said valve plate 5 and which are selectively and respectively closed by suction and discharge valves (not illustrated).

The gas being drawn by the compressor and coming from a suction line (not illustrated) of the refrigeration system to which the compressor is coupled, reaches the interior of the casing 1 through a suction muffler 6 usually provided within said casing 1 and maintained in fluid communication with the inside of the suction chamber of the compressor.

In the interior of the casing 1 there is defined, adjacent to a lower portion 1*a* thereof, an oil sump 7 which contains the oil for lubricating the motor-compressor assembly parts presenting relative movement to each other, the lubricating oil deposited in said oil sump 7 being pumped to the motor-compressor assembly by a non-illustrated pump. While the appended drawings illustrate a compressor with the cylinder block located over the electric motor, it should be understood that the invention encompasses the hermetic compressors in which the electric motor is provided over the cylinder block.

According to the present invention, inside the casing 1 there is provided a thermal energy transfer duct 20, which is for example flexible (heat pipe) and made of a material with good thermal conductibility, such as copper, and which has a heat absorbing end 21 mounted to the cylinder block 2 in a region of the latter at a high temperature as a function of the compression of the refrigerant fluid caused by the movement of the piston, so as to absorb the heat generated by compression of said refrigerant fluid inside the cylinder 3, and a heat releasing end 22 spaced away from the cylinder block 2 in order to conduct and liberate the heat absorbed therefrom to another means at a lower temperature than that of the means where absorption occurs.

Figure 2:
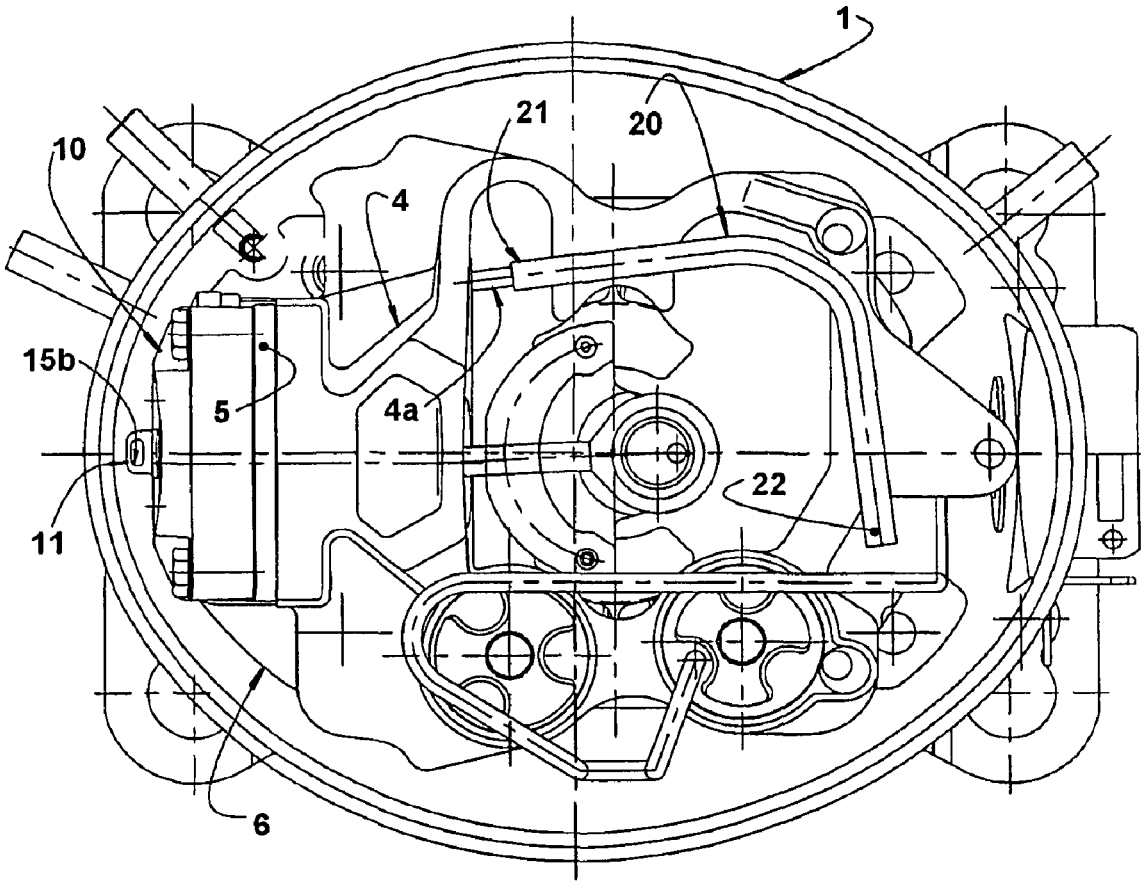
FIG. 2 illustrates, schematically and in a top plan view, the embodiment shown in FIG. 1.

FIGS. 1 and 2 illustrate a constructive option of the present invention in which the heat absorbing end 21 of the thermal energy transfer duct 20 is coupled to the cylinder block 2 in a mounting region adjacent to the valve plate 5. In this constructive option, the heat absorbing end 21 of the thermal energy transfer duct 20 is coupled to a projection 4*a* of the opposite end 4 of the cylinder block 2.

Figure 3:
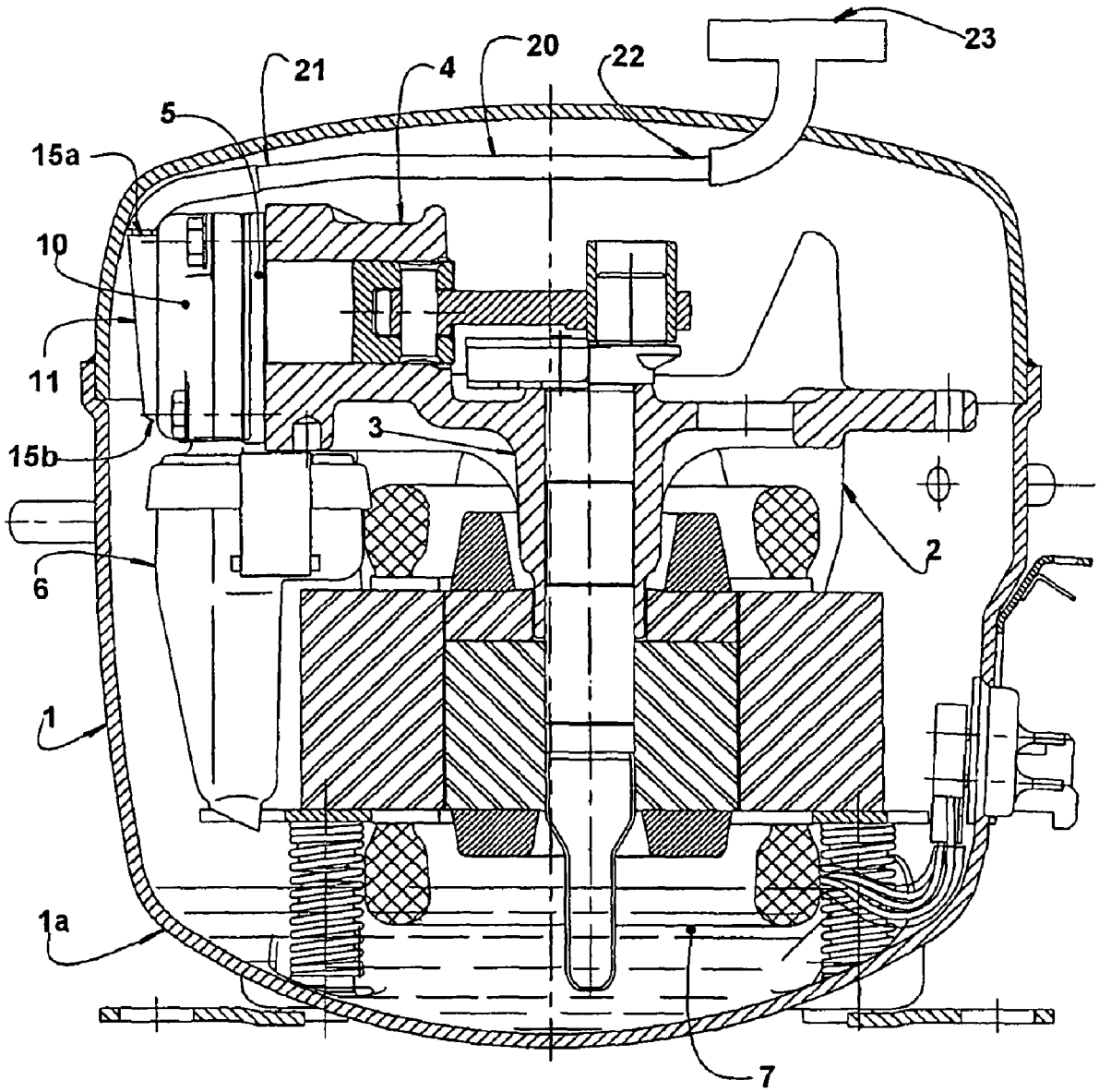
FIG. 3 illustrates, schematically and in a cross-sectional view, as in FIG. 1, a second embodiment of the refrigeration system.
Figure 4:
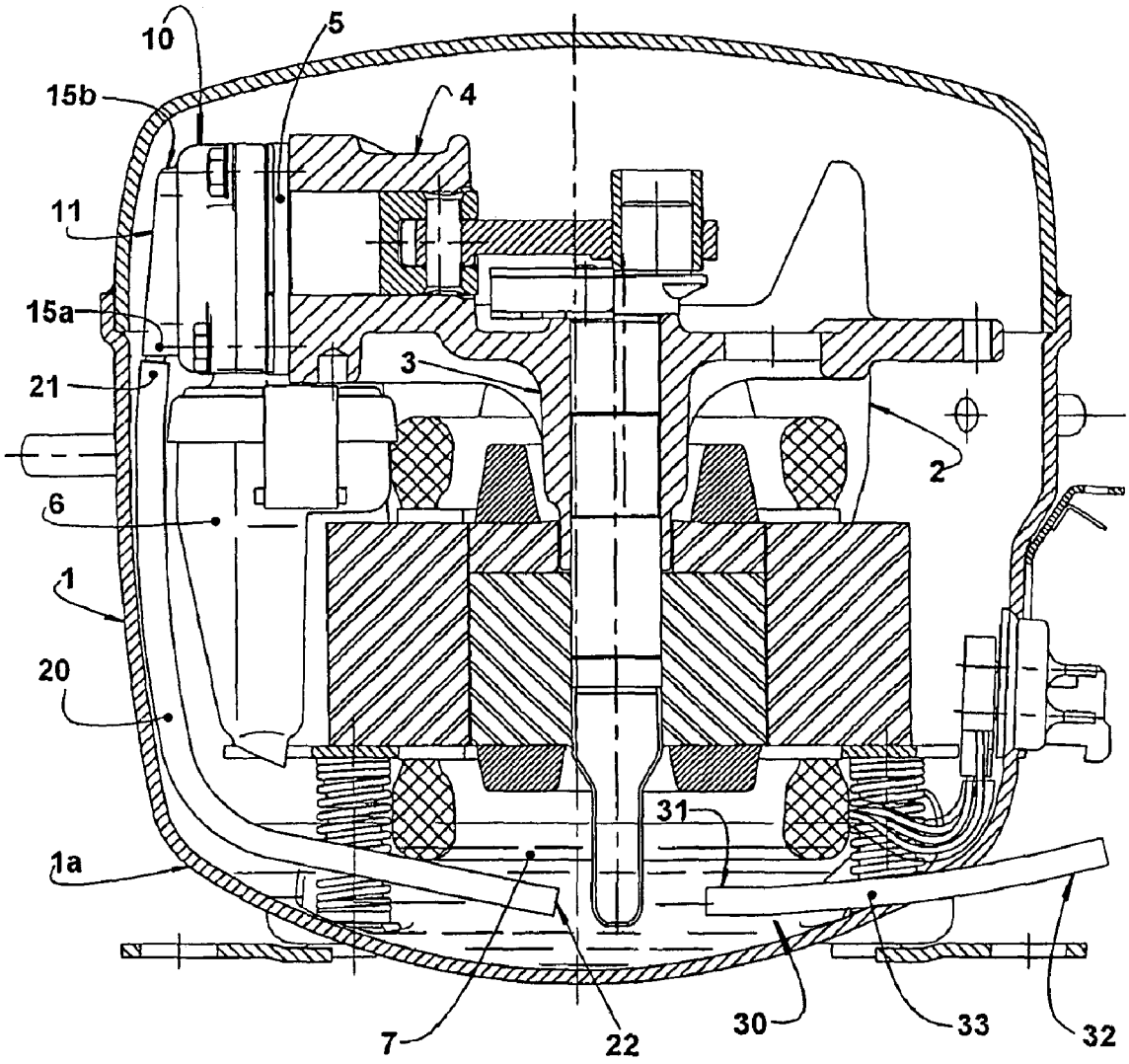
FIG. 4 illustrates, schematically and in a cross-sectional view, a variant for the second embodiment of the refrigeration system shown in FIG. 1.
Figure 5:
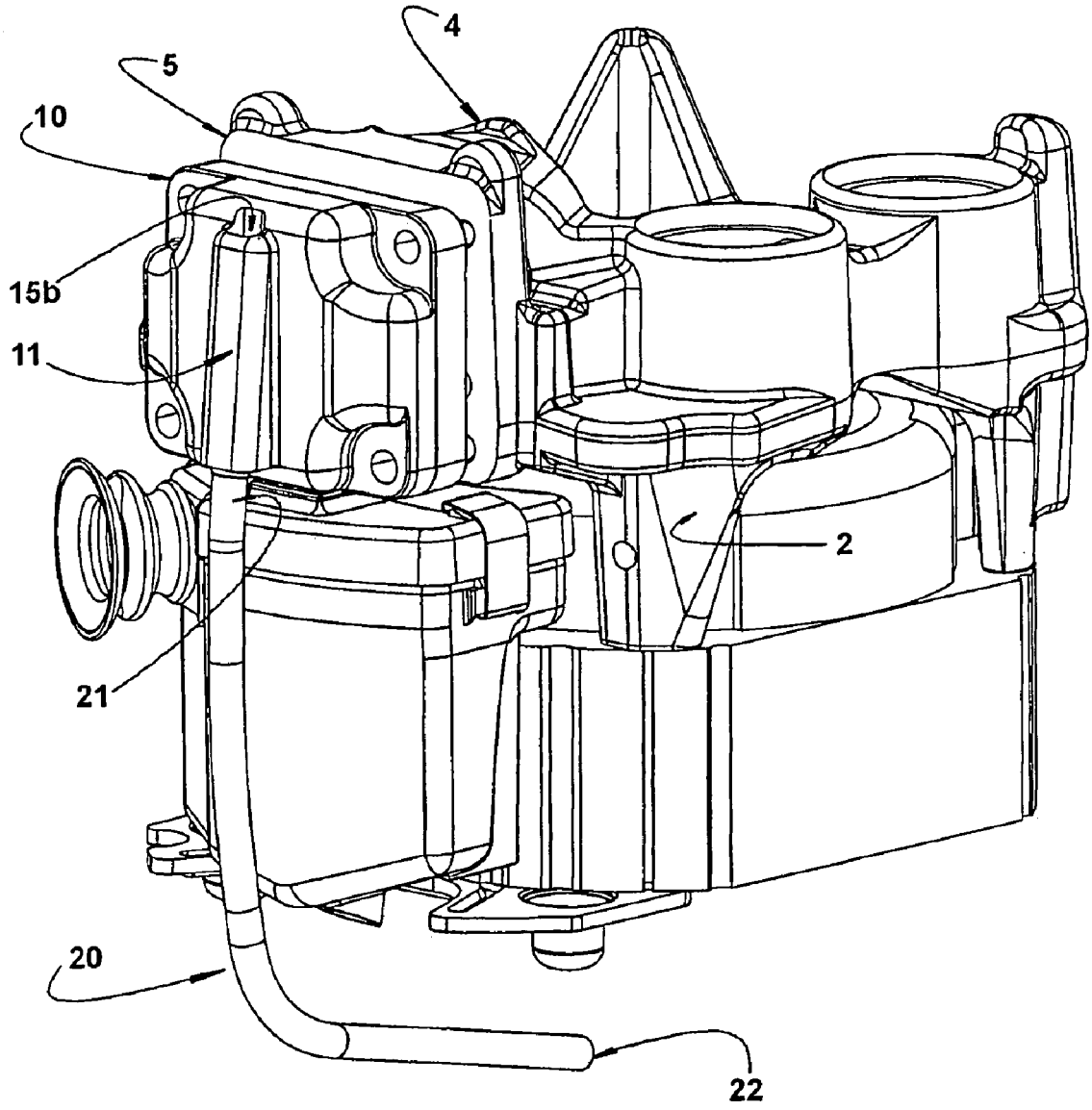
FIG. 5 illustrates, schematically, a perspective view of the construction shown in FIG. 4.

In another constructive option, the heat absorbing end 21 of the thermal energy transfer duct 20 is coupled to the cylinder head 10, as illustrated in FIGS. 3-5. In this construction, the cylinder head 10 is provided with at least one housing 11 to receive the heat absorbing end 21 of the thermal energy transfer duct 20, said housing 11 being provided with retaining means to secure the heat absorbing end 21, which means are for example incorporated to the housing 11.

Figure 6:
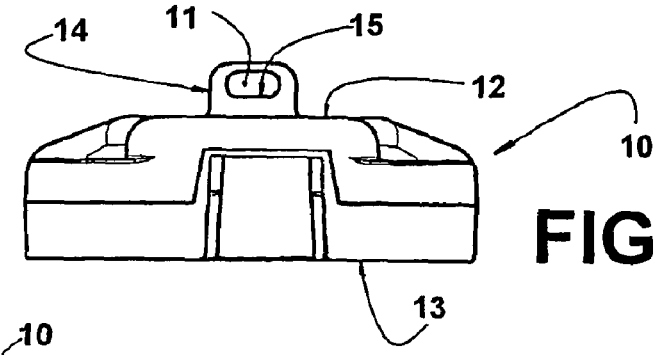
FIG. 6 illustrates, schematically, a bottom plan view of the construction of the cylinder head shown in FIG. 5.
Figure 7:
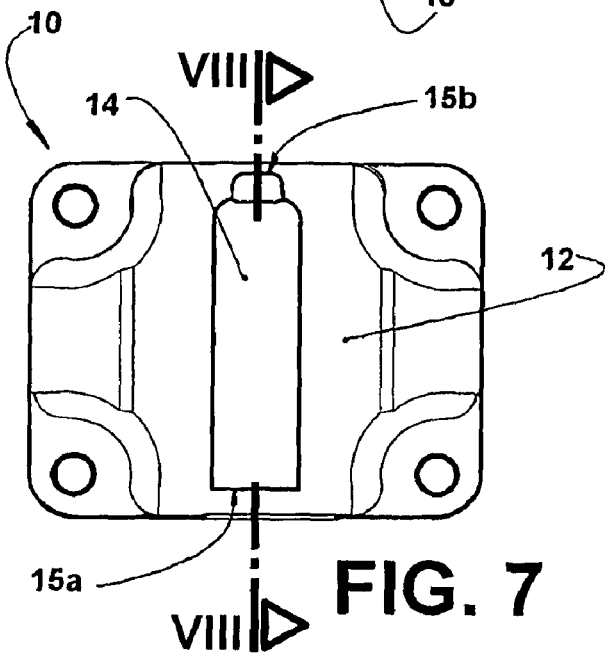
FIG. 7 illustrates, schematically, a lateral elevational view of the construction of the cylinder head shown in FIG. 6.
Figure 8:
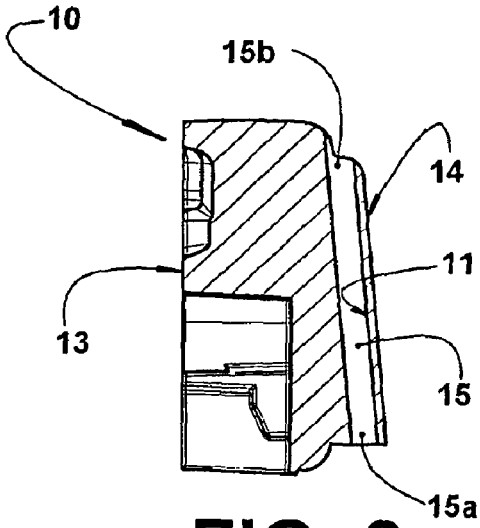
FIG. 8 illustrates, schematically, a vertical sectional view of the construction of the cylinder head shown in FIGS. 6 and 7, taken according to line VIII-VIII of FIG. 7.

In the construction of the cylinder head 10 illustrated in FIGS. 6-8, the cylinder head 10 carries, from a face 12 opposite to a mounting face 13 to be seated against the valve plate 5, a projection 14 defining, internally, a channel 15 which is for example rectilinear and provided along the longitudinal extension of said cylinder head 10, said channel 15 defining the housing 11.

According to the present invention, the channel 15 has a first end 15*a* which is open and dimensioned to receive the heat absorbing end 21 of the thermal energy transfer duct 20. In the illustrated construction, the channel 15 is further provided with a second end 15*b* which is open and dimensioned to receive, selectively, the heat absorbing end 21 of a thermal energy transfer duct 20, which may be provided independently of the provision of another thermal energy transfer duct 20 with its heat absorbing end 21 mounted to the first end 15*a* of the channel 15.

In another non-illustrated constructive option, each of the first and second ends 15*a*, 15*b* can receive, simultaneously or not, a heat absorbing end 21 of a respective thermal energy transfer duct 20.

In the illustrated embodiment, the channel 15 has a first end 15*a* and a second end 15*b* aligned to each other according to an axis which is inclined in relation to the plane of the face of said cylinder head 10 to be seated against the valve plate 5. The inclination of the axis of the channel 15 is defined so that the first end 15*a* is more spaced away from said face to be seated to the valve plate 5 in relation to the second end 15*b*, in order to facilitate the fitting, through any of said first and second ends 15*a*, 15*b* of the channel 15, of a heat absorbing end 21 of the thermal energy transfer duct 20, as illustrated in FIGS. 3 and 4, respectively.

In the constructive option for the cylinder head 10 illustrated in FIGS. 1, 4 and 5, the heat absorbing end 21 of the thermal energy transfer duct 20 is tightly fitted directly into the housing 11.

Figure 9:
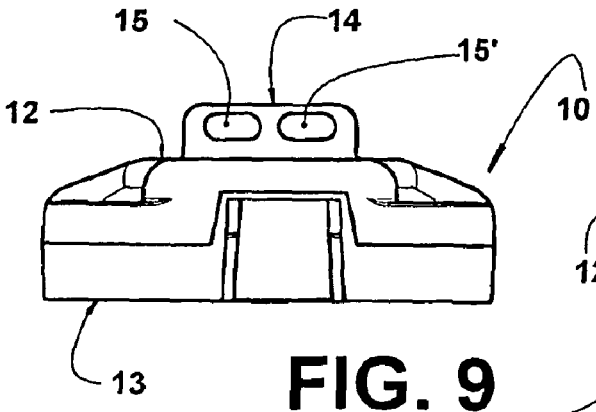
FIG. 9 illustrates, schematically, a bottom plan view of another construction of the cylinder head of the present invention.
Figure 10:
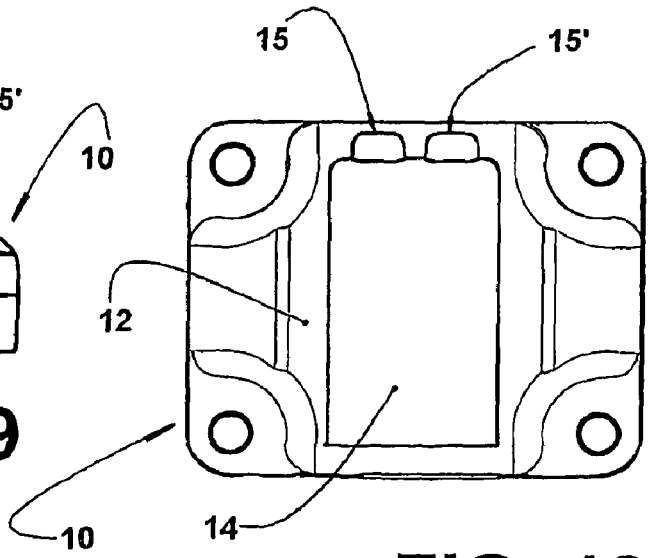
FIG. 10 illustrates, schematically, a lateral elevational view of the construction of the cylinder head shown in FIG. 9.

FIGS. 9 and 10 illustrate a constructive option for the cylinder head 10 of the present invention, in which said cylinder head 10 presents a pair of parallel channels 15, 15' laterally provided from the face 12 of the cylinder head 10, so that each receives a respective heat absorbing end 21 of a thermal energy transfer duct 20, as already discussed in relation to the cylinder head 10 shown in FIGS. 6-8.

It should be understood that the heat absorbing end 21 of the thermal energy transfer duct 20 might be mounted to the cylinder block 2 directly to any compressor component associated with the cylinder block 2, in order to receive, from the latter, the heat generated by compression of the refrigerant fluid.

According to a constructive option of the present invention illustrated in FIGS. 4 and 5, the heat releasing end 22 of the thermal energy transfer duct 20 liberates heat to a means located within the casing 1 and defined by the oil contained inside the latter, for example by immersing said heat releasing end 22 in the oil sump 7 defined inside the casing 1, so as to liberate heat to said oil sump 7. In this construction, the heat releasing end 22 can be loosely immersed in the oil sump 7 or retained therein by an appropriate retaining means. In a variant of this construction illustrated in FIG. 4, the present heat dissipation system comprises an additional thermal energy transfer duct 30 having a respective heat absorbing end 31 immersed in the oil of the oil sump 7, and a heat releasing end 32 outside said oil sump 7 to carry at least part of the heat from said oil to a region spaced away therefrom.

In the illustrated construction, the heat releasing end 32 of the additional thermal energy transfer duct 30 is provided with a duct portion 33 which hermetically trespasses the casing 1 in order to project outwardly therefrom and to liberate heat via the heat releasing end 32 to a means external to said casing 1, generally defined by the external ambient itself.

In another constructive option, not illustrated, the heat releasing end 22 of the thermal energy transfer duct 20 liberates heat to a flow of lubricant oil circulating inside the casing 1, for example the oil to be used to lubricate the compressor parts with relative movement to each other.

According to the present invention, the heat removed from the cylinder block can be also directed to the outside of the casing 1 without passing through the oil contained therewithin, as illustrated in FIG. 3.

In this case, said heat releasing end 22 of the thermal energy transfer duct 20 has an end portion 23 trespassing, hermetically, the casing 1, in order to project outwardly therefrom and liberate heat to a means external to said casing 1, as discussed above.

FIGS. 11 and 12 exemplify two constructive forms of a thermal energy transfer duct 20 (or additional thermal energy transfer duct 30) of the present invention, in which each of said ducts has a respective evaporator portion 20*a*, of heat absorption, a transport portion 20*b* or adiabatic portion, a condenser portion 20*c*, and a heat dissipation portion 20*d*, for example including at least one heat dissipating fin 20*e* provided along said heat dissipation portion 20*d*, as illustrated.

In the construction illustrated in FIG. 11, the condenser portion 20*c* is associated with a heat dissipating fin 20*e* disposed along the extension of said condenser portion 20*c*. In the construction illustrated in FIG. 12, the thermal energy transfer duct 20 comprises two heat dissipating portions 20*d*, one of them presenting a heat dissipating fin 20*e* disposed along the extension of the evaporator portion (heat absorption) 20*a* of the thermal energy transfer duct 20, and the other of said heat dissipating portions comprising a plurality of heat dissipating fins 20*e* disposed parallel to each other and transversal to the extension of the condenser portion 20*c*, said fins being transversally or longitudinally arranged in the thermal energy transfer duct 20 to increase the heat dissipation area of the latter. The provision of the heat dissipating fins 20*e*, as well as the arrangement and quantity thereof, is a function of the parameters of said thermal energy transfer duct 20, such as area, temperature and ventilation of the place where it is located.

As illustrated in FIGS. 11*a*, 11*b* and 11*c*, in a construction option of the present invention the evaporator portion 20*a* which forms the thermal energy transfer duct 20 presents a cross section which is different from the cross section of the other portions of said thermal energy transfer duct, which cross section is calculated as a function of the heat absorption parameters desired for that portion. This procedure is also applied to determine the cross section of the other portions of the thermal energy transfer duct.

For the thermal energy transfer duct constructions illustrated in FIGS. 11 and 12, the result of the quantity of heat versus temperature in the transport portion 20*b* (or adiabatic portion) of the thermal energy transfer duct 20 and the result of the quantity of heat versus effective unit of length of the thermal energy transfer duct (of the condenser portion 20*c*) of each construction of thermal energy transfer duct 20 are illustrated in FIGS. 13, 13*a*, 14, 14*a*.

Figure 13:
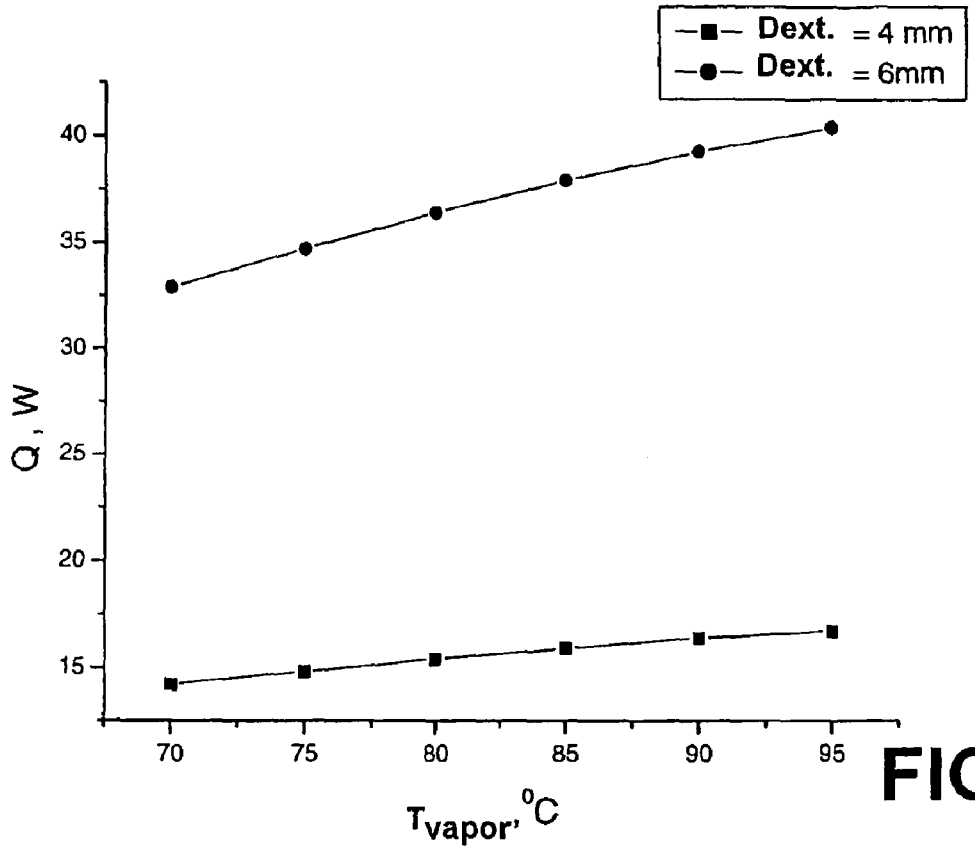
FIGS. 13 and 13*a* illustrate, schematically, the curves of the performance of the thermal energy transfer duct shown in FIG. 11.
Figure 13A:
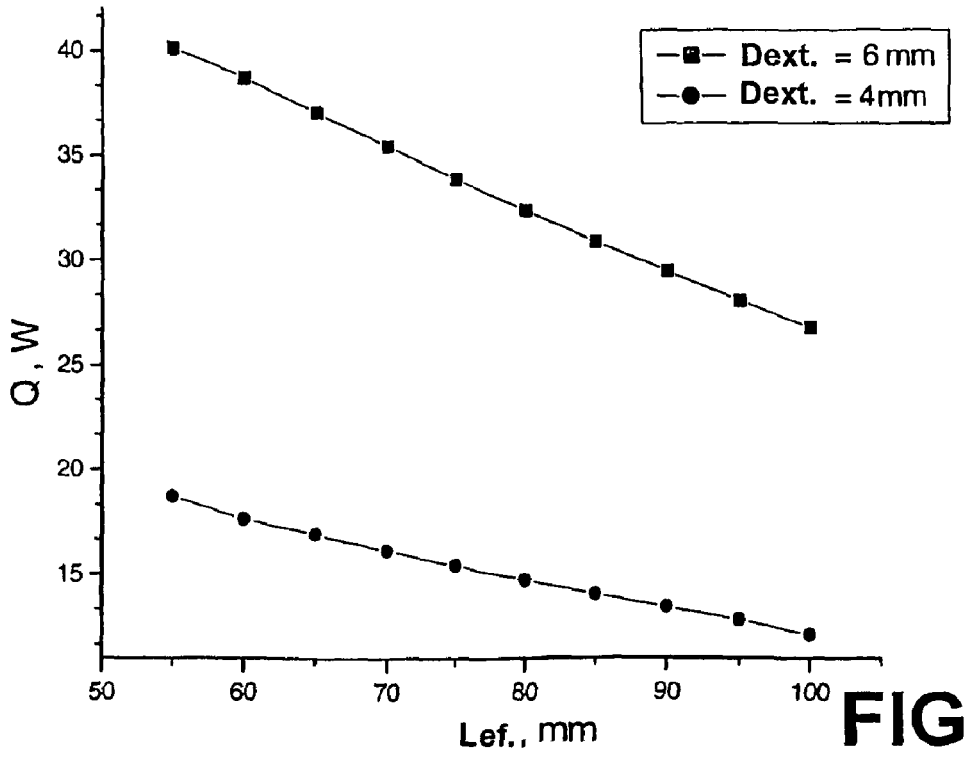
Figure 14:
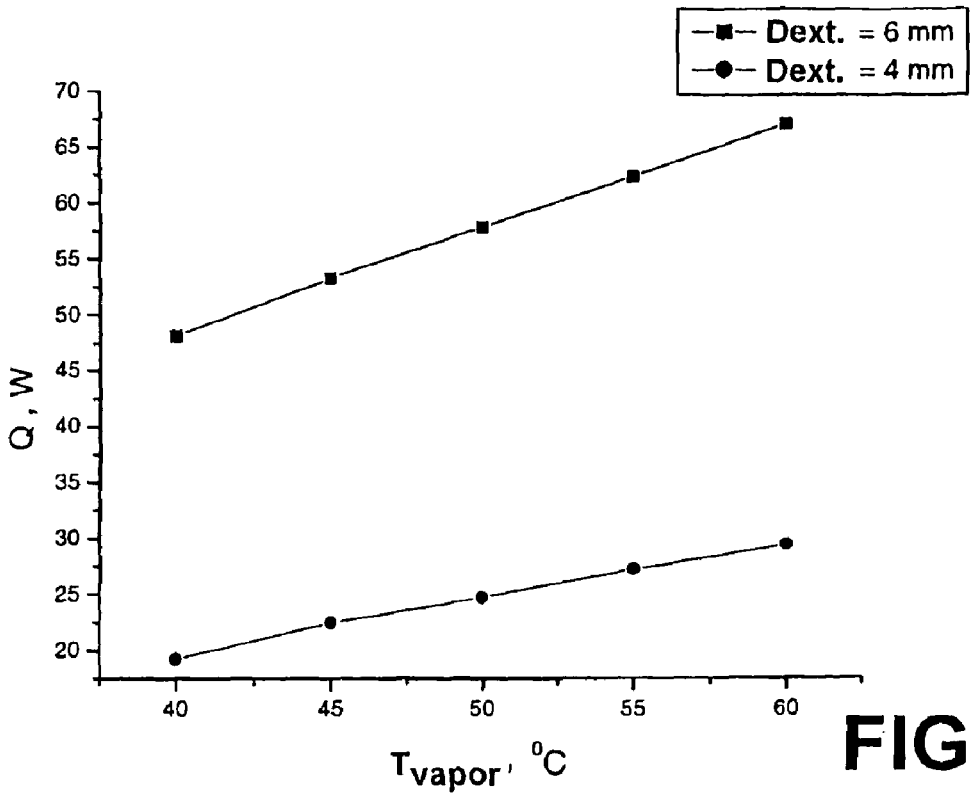
FIGS. 14 and 14*a* illustrate, schematically, the curves of the performance of the thermal energy transfer duct shown in FIG. 12.
Figure 14A:
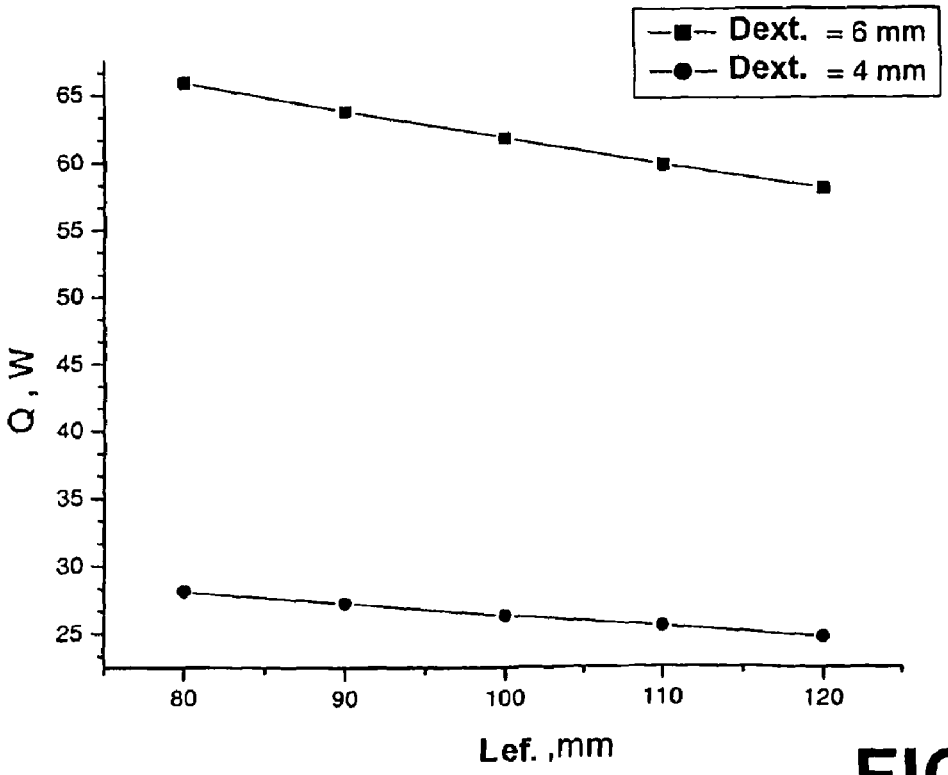

The effective length considered in the graphs illustrated in FIGS. 13*a* and 14*a* represents the sum of the length of the transport portion 20*b* (Ladb) and half of the sum of the lengths of the evaporator portion 20*a* (Levap) and condenser portion 20*c* (Lcond), i.e.:

$$Lef=Ladb+(Lcond+Levap)/2.$$

For obtaining such results, these thermal energy transfer duct constructions present an external diameter for example of about 6 mm and a copper wall thickness of about 0.5 mm. As illustrated in FIGS. 13, 13*a*, 14 and 14*a*, the represented curves were obtained for external diameters (Dext) of the thermal energy transfer duct of 4 mm and 6 mm.

With the solution of the present invention, the removal of heat from the hot region of the cylinder block 2 allows reducing the temperatures in the interior of the compressor, increasing the energetic efficiency of the compressor.

While only some ways of carrying out the invention have been illustrated, it should be understood that changes in the form and arrangement of the components of the compressor could be made without departing from the inventive concept defined in the appended claims.

The invention claimed is:

1. A hermetic compressor with a heat dissipating system, said compressor comprising:

a casing within which is defined an oil sump;

a cylinder block mounted inside the casing and defining a cylinder for compression of a refrigerant fluid, having an end closed by a cylinder head, comprising at least one thermal energy transfer duct having:

a heat absorbing end mounted to the cylinder block in order to absorb the heat generated by compression of the refrigerant fluid inside the cylinder, and a heat releasing end provided away from the cylinder block in order to conduct and liberate the heat absorbed, said thermal energy transfer duct having a respective evaporator portion, a transport portion, a condenser portion, and a heat dissipation portion, and said evaporator portion, said transport portion and said condenser portion of said duct being within said casing.

2. Hermetic compressor, according to claim 1, wherein the heat releasing end of the thermal energy transfer duct liberates heat to oil contained in the interior of the casing.

3. Hermetic compressor, according to claim 2, wherein the heat releasing end of the thermal energy transfer duct is immersed in the oil of the oil sump so as to liberate heat to the oil sump.

4. Hermetic compressor, according to claim 3, wherein the hermetic compressor comprises an additional thermal energy transfer duct having a respective heat absorbing end immersed in the oil of the oil sump, and a heat releasing end provided with a duct portion which trespasses, hermetically, the casing so as to project outwardly therefrom and liberate heat to an outside of the casing.

5. Hermetic compressor, according to claim 2, wherein the heat releasing end of the thermal energy transfer duct liberates heat to a flow of lubricant oil circulating in the interior of the casing.

6. Hermetic compressor, according to claim 3 and in which the cylinder head is mounted against a face of a valve plate provided with suction and discharge orifices which are selectively closed by respective suction and discharge valves, wherein the heat absorbing end of the thermal energy transfer duct is coupled to the cylinder block in a mounting region adjacent to the valve plate.

7. Hermetic compressor, according to claim 6, wherein the heat absorbing end of the thermal energy transfer duct is coupled to the cylinder head (10).

8. Hermetic compressor, according to claim 7, wherein the cylinder head is provided with at least one housing to receive a respective heat absorbing end of the thermal energy transfer duct.

9. Hermetic compressor, according to claim 8, wherein the heat absorbing end of the thermal energy transfer duct is affixed to the respective housing through retaining means carried by the latter.

10. Hermetic compressor, according to claim 9, wherein the retaining means are incorporated to the housing.

11. Hermetic compressor, according to claim 10, wherein the heat absorbing end of the thermal energy transfer duct is tightly fitted into the housing.

12. Hermetic compressor, according to claim 11, wherein the cylinder head incorporates a projection defining, therewithin, a channel having a first end which is open and dimensioned to receive the heat absorbing end of the thermal energy transfer duct.

13. Hermetic compressor, according to claim 12, wherein the channel is open and dimensioned to receive, selectively, a heat absorbing end of another thermal energy transfer duct, which may be provided independently of the provision of the thermal energy transfer duct, with both heat absorbing ends mounted to the first end of the channel.

14. Hermetic compressor, according to claim 1, wherein the heat releasing end of the thermal energy transfer duct has an end portion trespassing, hermetically, the casing so as to project outwardly therefrom and liberate heat to an outside of the casing.

* * * * *